US008655245B2

(12) United States Patent
Moon et al.

(10) Patent No.: US 8,655,245 B2
(45) Date of Patent: Feb. 18, 2014

(54) FUSING DEVICE WITH CURVED NIP FORMING MEMBER AND IMAGE FORMING APPARATUS HAVING THE SAME

(75) Inventors: Sang Cheol Moon, Suwon-si (KR); Hwan Hee Kim, Suwon-si (KR); Dae Won Kang, Goyang-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 434 days.

(21) Appl. No.: 12/926,296

(22) Filed: Nov. 8, 2010

(65) Prior Publication Data

US 2012/0107029 A1 May 3, 2012

(30) Foreign Application Priority Data

Nov. 1, 2010 (KR) ..... 10-2010-0107755

(51) Int. Cl.
*G03G 15/20* (2006.01)

(52) U.S. Cl.
USPC ..... 399/329

(58) Field of Classification Search
USPC ..... 399/329, 328, 320, 335; 219/216
See application file for complete search history.

(56) References Cited

U.S. PATENT DOCUMENTS

2009/0110451 A1 * 4/2009 Jung et al. ..... 399/329

FOREIGN PATENT DOCUMENTS

JP 08006409 A * 1/1996 ..... G03G 15/20
JP 2004-158245 6/2004
JP 2007171749 A * 7/2007

* cited by examiner

*Primary Examiner* — Walter L Lindsay, Jr.
*Assistant Examiner* — Billy J Lactaoen
(74) *Attorney, Agent, or Firm* — Staas & Halsey LLP

(57) ABSTRACT

An image forming apparatus including a fusing belt, a pressure roller disposed to face the fusing belt so as to press a recording medium onto the fusing belt, a nip forming member to support an inner surface of the fusing belt so as to form a fusing nip along with the pressure roller, and a heat source disposed inside the fusing belt to simultaneously apply radiant heat to the fusing belt and the nip forming member. The nip forming member includes a hill portion, which is located to one side thereof farther downstream in a movement direction of the recording medium and protrudes toward the hill portion. The hill portion causes the recording medium, which has curled in a given direction, to be bent in an opposite direction immediately prior to exiting from between the nip forming member and the pressure roller, thereby reducing curling of the recording medium.

24 Claims, 8 Drawing Sheets

FUSING DEVICE WITH CURVED NIP FORMING MEMBER AND IMAGE FORMING APPARATUS HAVING THE SAME

CROSS-REFERENCE TO RELATED APPLICATIONS

This application claims the benefit of Korean Patent Application No. 2010-0107755, filed on Nov. 1, 2010 in the Korean Intellectual Property Office, the disclosure of which is incorporated herein by reference.

BACKGROUND

1. Field

Embodiments relate to a fusing device to fix an image to a recording medium by applying heat to the image and an image forming apparatus having the same.

2. Description of the Related Art

Image forming apparatuses are devised to print an image on a recording medium. Examples of image forming apparatuses include printers, copiers, fax machines, and devices combining functions thereof.

In an electro-photographic image forming apparatus, after light is irradiated to a photoconductor charged with a predetermined electric potential to form an electrostatic latent image on a surface of the photoconductor, a developer is fed to the electrostatic latent image so as to form a visible image. The visible image, formed on the photoconductor, is transferred to a recording medium. The visible image transferred to the recording medium is fixed to the recording medium while passing through a fusing device.

A generally widely used fusing device includes a heating roller having a heat source therein, and a pressure roller arranged to come into close contact with the heating roller so as to define a fusing nip. When a recording medium onto which an image has been transferred enters the fusing nip between the heating roller and the pressure roller, the image is fixed to the recording medium under the influence of heat and pressure acting on the fusing nip.

SUMMARY

Therefore, it is an aspect to provide a fusing device having an improvement to reduce curling of a recording medium caused while developer is fused to the recording medium, and an image forming apparatus having the same.

Additional aspects will be set forth in part in the description which follows and, in part, will be apparent from the description, or may be learned by practice of the invention.

In accordance with one aspect, a fusing device includes a fusing belt, a pressure roller disposed to face the fusing belt and serving to press a recording medium onto the fusing belt, a nip forming member to support an inner surface of the fusing belt so as to form a fusing nip along with the pressure roller, and a heat source disposed inside the fusing belt to simultaneously apply radiant heat to the fusing belt and the nip forming member, wherein the nip forming member includes a first surface provided upstream in a movement direction of the recording medium and configured to ascend toward the pressure roller in the movement direction of the recording medium, a second surface provided downstream in the movement direction of the recording medium and configured to descend away from the pressure roller in the movement direction of the recording medium, and a hill portion formed at a boundary between the first surface and the second surface, and the hill portion is located to one side of the nip forming member farther downstream in the movement direction of the recording medium.

The hill portion may be formed of a curved surface.

At least one of the first surface and the second surface may be a curved surface.

The first surface and the second surface may be respectively curved surfaces, and the second surface may have a smaller radius of curvature than the first surface.

The first surface may be an inclined surface and the second surface may be a curved surface.

The first surface and the second surface may be respectively inclined surfaces.

The second surface may have a greater inclination angle than the first surface.

The hill portion may be located at a position three quarters of the nip forming member farther downstream in the movement direction of the recording medium.

The nip forming member may be made of aluminum, and may include an oxide film formed on the first surface, the second surface and a surface of the hill portion through anodization, and a ceramic-teflon coating layer is formed on the oxide film.

The heat source may include a lamp to generate radiant heat.

The fusing device may further include a supporting member to rotatably support the fusing belt, inside of which the heat source is disposed, a belt guide member to support the fusing belt near the fusing nip, to which the nip forming member is installed, and a heat transfer member disposed to face the heat source to transfer the heat generated from the heat source to the nip forming member.

The heat transfer member may include a body disposed to face the heat source, a pair of extensions spaced apart from each other to extend toward the nip forming member, and heat transfer portions provided at ends of the pair of extensions to transfer heat to the nip forming member.

The nip forming member may include a recessed receiving portion in which the heat transfer portions are received.

The supporting member may include a first opening to allow the radiant heat generated from the heat source to reach the nip forming member, and a second opening to allow the radiant heat generated from the heat source to reach the fusing belt, the heat transfer member may include a third opening corresponding to the second opening provided at an opposite side of the heat transfer portions, and the belt guide member may include a fourth opening corresponding to the first opening and the pair of extensions.

One of the nip forming member and the belt guide member may be provided with a protrusion, and the other one of the nip forming member and the belt guide member may be provided with a recess to correspond to the protrusion.

In accordance with another aspect, a fusing device includes a fusing belt, a pressure roller disposed to face the fusing belt and serving to press a recording medium onto the fusing belt, a nip forming member to support an inner surface of the fusing belt so as to form a fusing nip along with the pressure roller, and a heat source disposed inside the fusing belt to simultaneously apply radiant heat to the fusing belt and the nip forming member, wherein the nip forming member includes a first surface provided upstream in a movement direction of the recording medium, the first surface being a curved surface, a second surface provided downstream in the movement direction of the recording medium, the second surface being a curved surface having a smaller radius of curvature than that the first surface, and a hill portion formed at a boundary between the first surface and the second surface and formed of a curved surface, and the hill portion is located to one side of the nip forming member farther downstream in the movement direction of the recording medium.

In accordance with another aspect, a fusing device includes a fusing belt, a pressure roller disposed to face the fusing belt and serving to press a recording medium onto the fusing belt, a nip forming member to support an inner surface of the fusing belt so as to form a fusing nip along with the pressure roller, and a heat source disposed inside the fusing belt to simultaneously apply radiant heat to the fusing belt and the nip forming member, wherein the nip forming member includes a hill portion protruding toward the pressure roller and located to one side of the nip forming member farther downstream in a movement direction of the recording medium.

In accordance with a further aspect, an image forming apparatus includes a fusing device to apply heat and pressure to a recording medium passing through a fusing nip, wherein the fusing device includes a fusing belt, a pressure roller disposed to face the fusing belt, a nip forming member to support an inner surface of the fusing belt so as to form the fusing nip along with the pressure roller, and a heat source disposed inside the fusing belt to simultaneously apply radiant heat to the fusing belt and the nip forming member, wherein the nip forming member includes a first surface provided upstream in a movement direction of the recording medium and configured to ascend toward the pressure roller in the movement direction of the recording medium, a second surface provided downstream in the movement direction of the recording medium and configured to descend away from the pressure roller in the movement direction of the recording medium, and a hill portion formed at a boundary between the first surface and the second surface, and the hill portion is located to one side of the nip forming member farther downstream in the movement direction of the recording medium.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
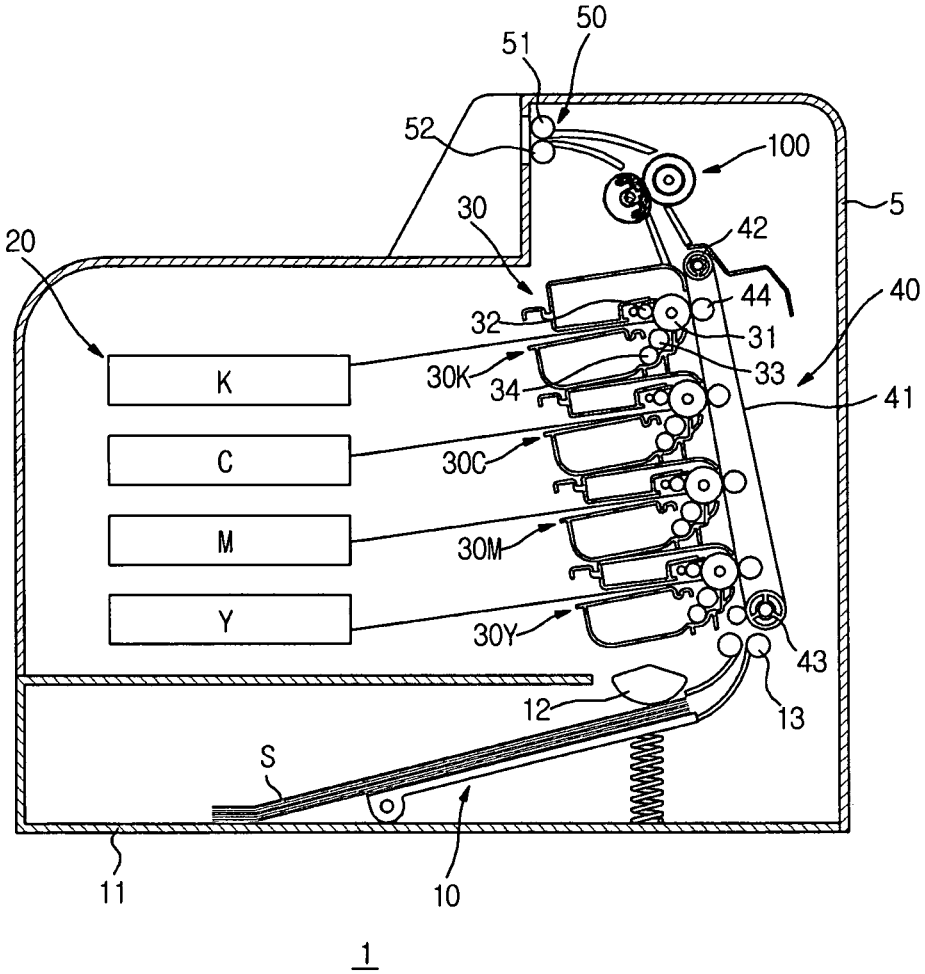
FIG. 1 is a schematic view of an image forming apparatus according to an embodiment.

Reference will now be made in detail to the embodiments, examples of which are illustrated in the accompanying drawings, wherein like reference numerals refer to like elements throughout.

Hereinafter, an image forming apparatus according to the embodiment will be described in detail with reference to the accompanying drawings.

As illustrated in FIG. 1, the image forming apparatus 1 includes a main body 5, a recording medium feeding device 10, a light scanning device 20, a developing device 30, a transfer device 40, a fusing device 100, and a recording medium discharge device 50.

The main body 5 defines an external appearance of the image forming apparatus 1 and supports a variety of elements installed therein. A part of the main body 5 may be configured to be opened or closed. This allows a user to exchange or repair the variety of elements through the open part of the main body 5 or to remove a recording medium jammed in the main body 5.

The recording medium feeding device 10 serves to feed a recording medium S to the developing device 30. The recording medium feeding device 10 includes a cassette 11 detachably mounted in the main body 5. The recording medium S is accommodated in the cassette 11 and is picked up sheet by sheet by a pickup roller 12 during a printing operation. The recording medium S picked up by the pickup roller 12 is delivered to the developing device 30 by a delivery roller 13.

The light scanning device 20 serves to form an electrostatic latent image by irradiating light corresponding to image information input from an external appliance, such as a computer, onto a photoconductor 31. In the case of the color image forming apparatus as illustrated in FIG. 1, the light scanning device 20 is configured to irradiate light corresponding to Yellow, Magenta, Cyan and Black colors onto the photoconductor 31.

The developing device 30 may include four developing units 30Y, 30M, 30C and 30K in which different colors of developers, e.g., yellow, magenta, cyan and black developers Y, M, C and K are received respectively. The photoconductor 31 may be provided in each of the developing units 30Y, 30M, 30C and 30K.

Each of the developing units 30Y, 30M, 30C and 30K includes a charging roller 32 to electrically charge the photoconductor 31, a developing roller 33 to supply the developer to the electrostatic latent image formed on the photoconductor 31 so as to form a visible image, and a supply roller 34 to supply the developer to the developing roller 33.

The transfer device 40 transfers the developer image formed on the photoconductor 31 to the recording medium S. The transfer device 40 includes a transfer belt 41 adapted to circulate while in contact with the respective photoconductors 31, a transfer belt drive roller 42 to drive the transfer belt 41, a tension roller 43 to maintain tension of the transfer belt 41, and four transfer rollers 44 to transfer the developer images formed on the respective photoconductors 31 to the recording medium S.

The recording medium S is delivered while being adhered to the transfer belt 41. In this case, a voltage having a polarity opposite to that of the developer attached to the photoconductor 31 is applied to the transfer roller 44, causing the developer image on the photoconductor 31 to be transferred to the recording medium S.

The fusing device 100 is configured to apply heat and pressure to the recording medium S so as to fix a non-fused image on the recording medium S to the recording medium S. A detailed description related to the fusing device 100 will be described hereinafter.

The recording medium discharge device 50 serves to discharge the recording medium S having passed through the fusing device 100 out of the image forming apparatus 1. The recording medium discharge device 50 includes a discharge roller 51 and a discharge backup roller 52 arranged to face each other.

Figure 2:
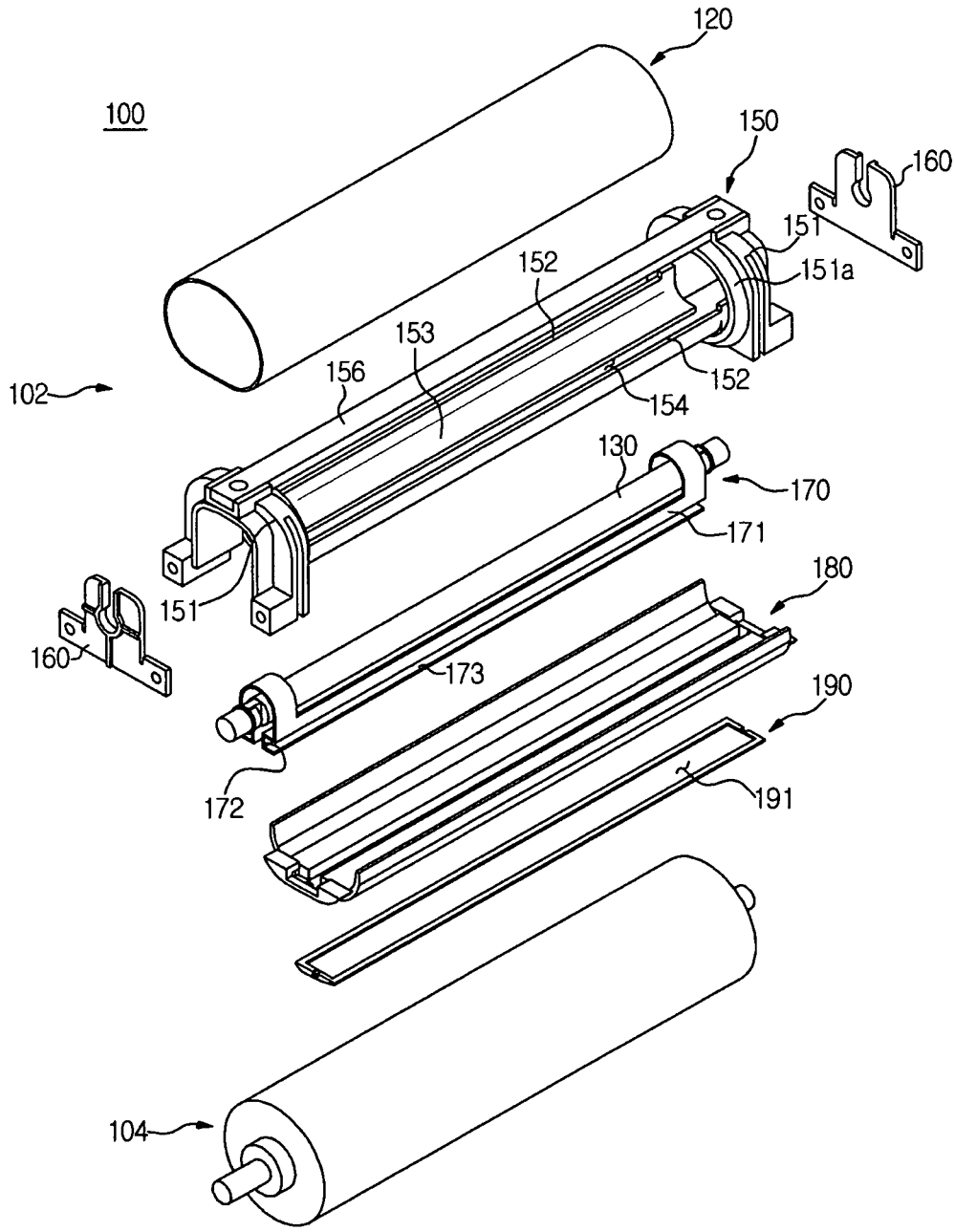
FIG. 2 is an exploded perspective view of a fusing device provided in the image forming apparatus according to the embodiment.
Figure 3:
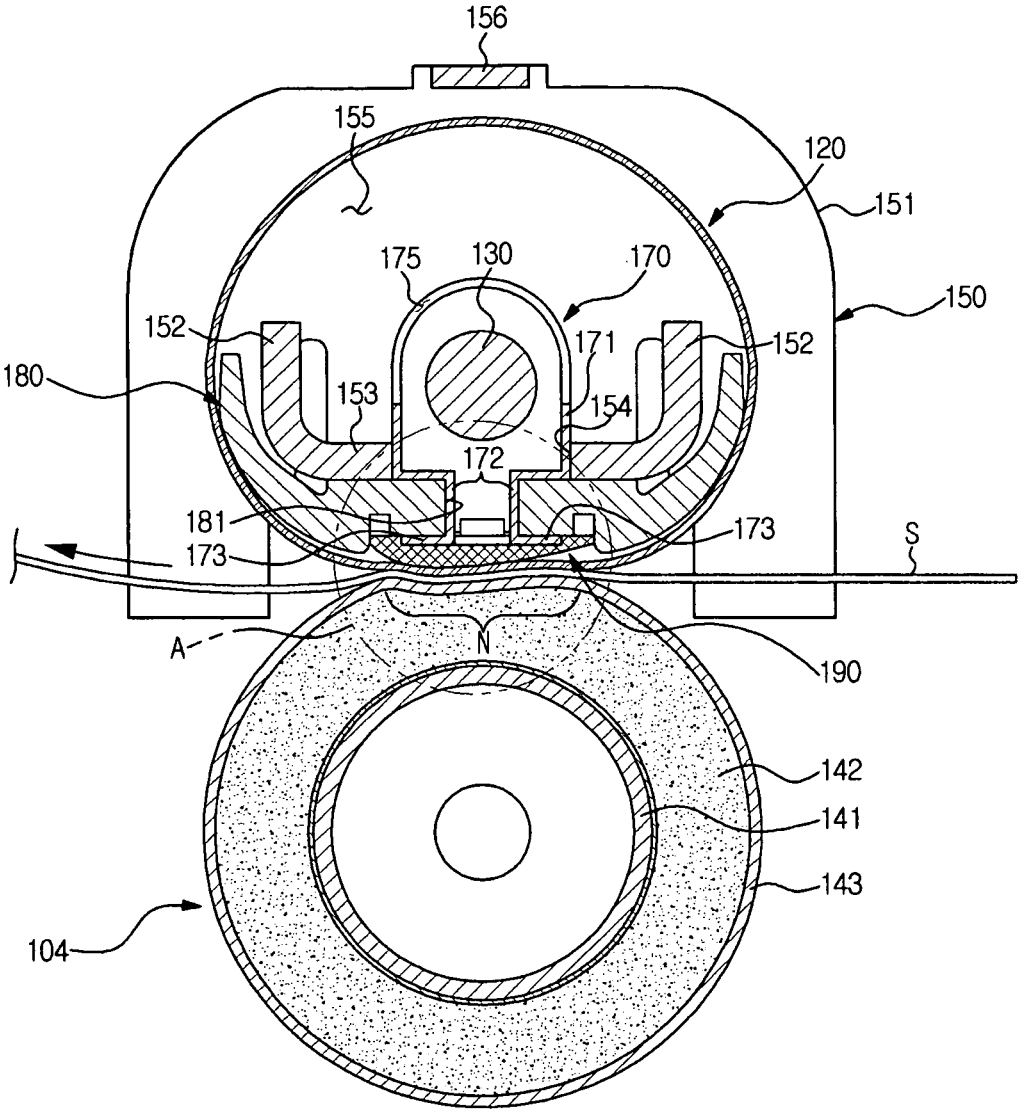
FIG. 3 is a sectional view of the fusing device provided in the image forming apparatus according to the embodiment.

As shown in FIGS. 2 and 3, the fusing device 100 includes a heating unit 102 and a pressure roller 104, and serves to apply heat and pressure to the recording medium S passing between the heating unit 102 and the pressure roller 104.

The heating unit 102 and the pressure roller 104 are arranged to face each, so as to define a fusing nip N through which the recording medium S passes. In a state wherein the image on a surface of the recording medium S is not yet fused, the heating unit 102 may come into contact with the surface of the recording medium S thus transferring heat to the recording medium S. The pressure roller 104 comes into contact with the heating unit 102 so as to apply pressure to the heating unit 102.

The heating unit 102 includes a fusing belt 120, a heat source 130, a supporting member 150, a heat transfer member 170, a belt guide member 180 and a nip forming member 190. The recording medium S, onto which the developer image has been transferred, passes through the fusing nip N between the pressure roller 104 and the fusing belt 120. At this time, the developer image is fixed to the recording medium S upon receiving heat and pressure.

The fusing belt 120 is rotatably supported on the supporting member 150 and is rotated while being engaged with the pressure roller 104. The fusing belt 120 is heated by the heat source 130, thus acting to transfer heat to the recording medium S passing through the fusing nip N.

The heat source 130 is arranged inside the fusing belt 120. Both ends of the heat source 130 are coupled respectively to side covers 160. The side covers 160 are fixed to the supporting member 150 so that the heat source 130 is supported by the supporting member 150. The heat source 130 may include, e.g., a halogen lamp to generate radiant heat.

The supporting member 150 is arranged to surround the heat source 130 and is made of a high-strength material so as not to be easily deformed by external force. The supporting member 150 may include side pieces 151, supporting plates 152, and bending plates 153.

The side pieces 151 are arranged respectively at both sides of the supporting member 150 and each has an inwardly protruding belt supporting portion 151*a* formed at an inner surface thereof to support a corresponding end of the fusing belt 120.

The supporting plates 152 extend between the side pieces 151 in a width direction of the supporting member 150 to connect the side pieces 151 to each other. The supporting plates 152 are spaced apart in parallel from each other.

The bending plates 153 are bent inward from the respective supporting plates 152. A first opening 154 is defined between the bending plates 153. A part of heat emitted from the heat source 130 is transferred to the fusing nip N through the first opening 154.

The supporting member 150 has a second opening 155 defined at an opposite side of the first opening 154. The second opening 155 allows radiant heat from the heat source 130 to directly reach the fusing belt 120 across the supporting member 150.

The supporting member 150 may further include a reinforcement plate 156 to connect the side pieces 151 to each other at the outside of the fusing belt 120. The reinforcement plate 156 increases the strength of the supporting member 150 to prevent deformation of the supporting member 150.

The heat transfer member 170 serves to transfer the heat generated from the heat source 130 to the nip forming member 190. The heat transfer member 170 includes a body 171 disposed to face the heat source 130, a pair of extensions 172 extending from one end of the body 171 toward the nip forming member 190 by penetrating the belt guide member 180, and heat transfer portions 173 provided at ends of the pair of extensions 172 to come into contact with the nip forming member 190 so as to transfer heat to the nip forming member 190. The two extensions 172 are spaced apart from each other to allow the radiant heat generated from the heat source 130 to be directly transferred to the nip forming member 190. Once the body 171 is heated by the heat source 130, heat of the body 171 is transferred to the nip forming member 190 via the extensions 172 and the heat transfer portions 173.

The heat transfer member 170 may be made of a metallic material having a low specific heat and high thermal conductivity, so that a temperature of the heat transfer member 170 rapidly rises to effectively transfer heat to the fusing belt 120 and the recording medium S.

The body 171 of the heat transfer member 170 has a third opening 175 at an opposite side of the heat transfer portions 173 to correspond to the second opening 155. In this way, the heat source 130 may directly apply radiant heat to the fusing belt 120 through the third opening 175 of the heat transfer member 170 and the second opening 155 of the supporting member 150.

This may allow more rapid increase in the temperature of the fusing belt 120 and may prevent deterioration in the temperature of the fusing belt 120 during rotation of the fusing belt 120.

The belt guide member 180 serves to support an inner surface of the fusing belt 120 near the fusing nip N to guide the fusing belt 120. An upper portion of the belt guide member 180 is supported by the supporting member 150. The belt guide member 180 is centrally provided with a fourth opening 181 to correspond to the extensions of the heat transfer member 170 and the first opening 154 of the supporting member 150.

With the above described configuration, heat generated from the heat source 130 reaches the nip forming member 190 through the first opening 154 of the supporting member 150 and the fourth opening 181 of the belt guide member 180, and also, reaches the fusing belt 120 through the second opening 155 of the supporting member 150 and the third opening 175 of the heat transfer member 170. In this way, the heat source 130 may simultaneously apply radiant heat to the nip forming member 190 and the fusing belt 120.

A lower surface of the belt guide member 180 supports the nip forming member 190 against pressure applied from the pressure roller 104. An inner edge of the belt guide member 180 defining the fourth opening 181 supports outer sides of the two extensions 172 of the heat transfer member 170, to prevent expansion of a gap between the two extensions 172 of the heat transfer member 170.

The nip forming member 190 supports the inner surface of the fusing belt 120 to define the fusing nip N along with the pressure roller 104. The nip forming member 190 has a recessed receiving portion 191 indented in a rear surface thereof such that the heat transfer portions 173 of the heat transfer member 170 are closely received in the recessed receiving portion 191.

Figure 4:
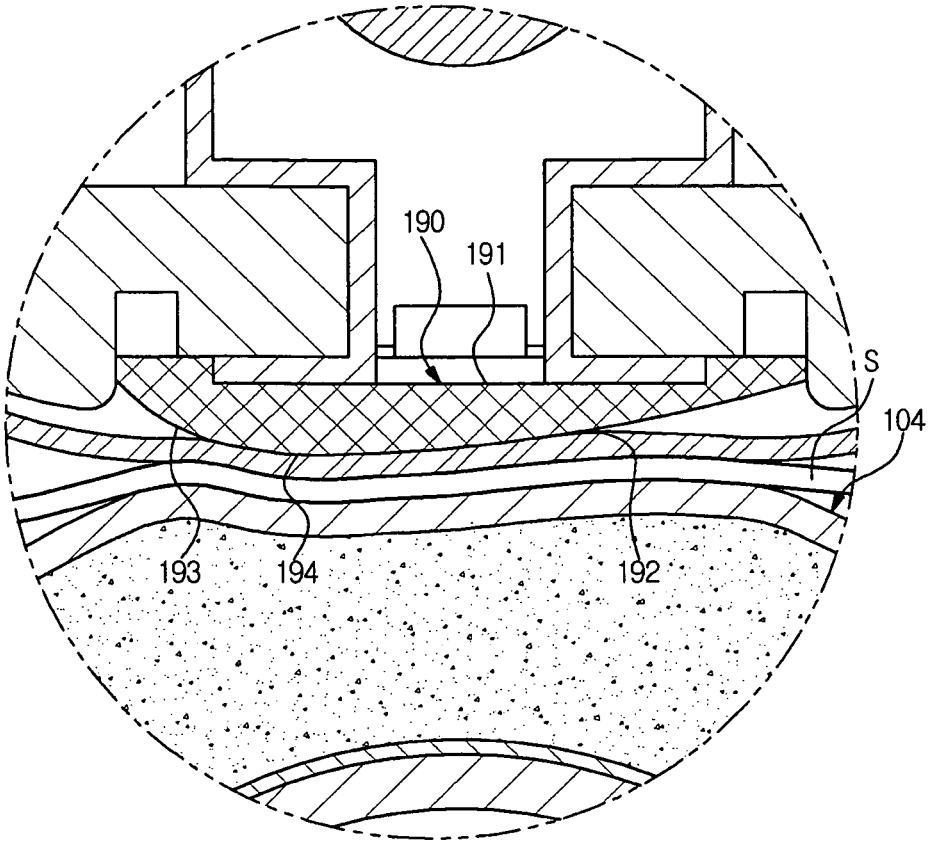
FIG. 4 is an enlarged view of the portion A of FIG. 4.

The nip forming member 190, as illustrated in FIG. 4, includes a front surface to support the fusing belt 120, and the front surface of the nip forming member 190 includes a first surface 192 provided upstream in a movement direction of the recording medium S and a second surface 193 provided downstream in the movement direction of the recording medium S. The first surface 192 is configured to gradually ascend toward the pressure roller 104 in the movement direction of the recording medium S, and the second surface 193 is configured to gradually descend away from the pressure roller 104 in the movement direction of the recording medium S. A hill portion 194 protruding toward the pressure roller 104 is formed at a boundary between the first surface 192 and the second surface 193.

To allow the nip forming member 190 and the pressure roller 104 to apply gradually increasing or decreasing force to the recording medium S, the first surface 192 and the second surface 193 of the nip forming member 190 are curved.

The hill portion 194 is also curved to allow the recording medium S to easily pass the hill portion 194. The hill portion 194 is located to one side of the nip forming member 190 farther downstream in the movement direction of the recording medium S. Thereby, the recording medium S passes the hill portion 194 of the nip forming member 190 immediately prior to exiting from between the nip forming member 190 and the pressure roller 104.

In the present embodiment, the second surface 193 is a curved surface having a smaller radius of curvature than the first surface 192, and the hill portion 194 is located at a position three quarters of the nip forming member 190 farther downstream in the movement direction of the recording medium S.

The nip forming member 190 is made of a material having a low specific heat and high thermal conductivity to effectively transfer heat to the recording medium S. In the present embodiment, the nip forming member 190 is made of aluminum. Although not illustrated in the drawing, an oxide film is formed on the first surface 192, the second surface 193 and the hill portion 194 of the nip forming member 190 through anodization, and a ceramic-teflon coating layer is formed on the oxide film, to improve wear-resistance of the nip forming member 190.

When providing the nip forming member 190 with the first surface 192, the second surface 193 and the hill portion 194, the recording medium S may curl to conform to an outer circumferential surface of the pressure roller 104 while passing between the first surface 192 and the pressure roller 104.

The curled recording medium S continuously passes between the first surface 192 and the pressure roller 104. Then, the recording medium S is temporarily bent in an opposite direction of a curling direction thereof while passing between the hill portion 194 and the pressure roller 104. The hill portion 194 acts to limit curling of the recording medium S. Thus, the curling degree of the recording medium S is reduced while the recording medium S passes between the hill portion 194 and the pressure roller 104.

The recording medium S having passed through the hill portion 194 passes between the second surface 193 and the pressure roller 104. Since the hill portion 194 is located to one side of the nip forming member 190 farther downstream in the movement direction of the recording medium S as described above, the second surface 193 provided downstream in the movement direction of the recording medium S is shorter than the first surface 192. Also, since the second surface 193 is configured to gradually descend away from the pressure roller 104, a significantly reduced pressure is applied to the recording medium S passing between the second surface 193 and the pressure roller 104. Thereby, the recording medium S has almost no increase in curling degree while passing between the second surface 193 and the pressure roller 104.

The nip forming member 190 is installed to the lower surface of the above described belt guide member 180. Since the hill portion 194 of the nip forming member 190 is located to one side of the nip forming member 190 farther downstream in the movement direction of the recording medium S, carefully determining an installation direction of the nip forming member 190 may be important.

Figure 5:
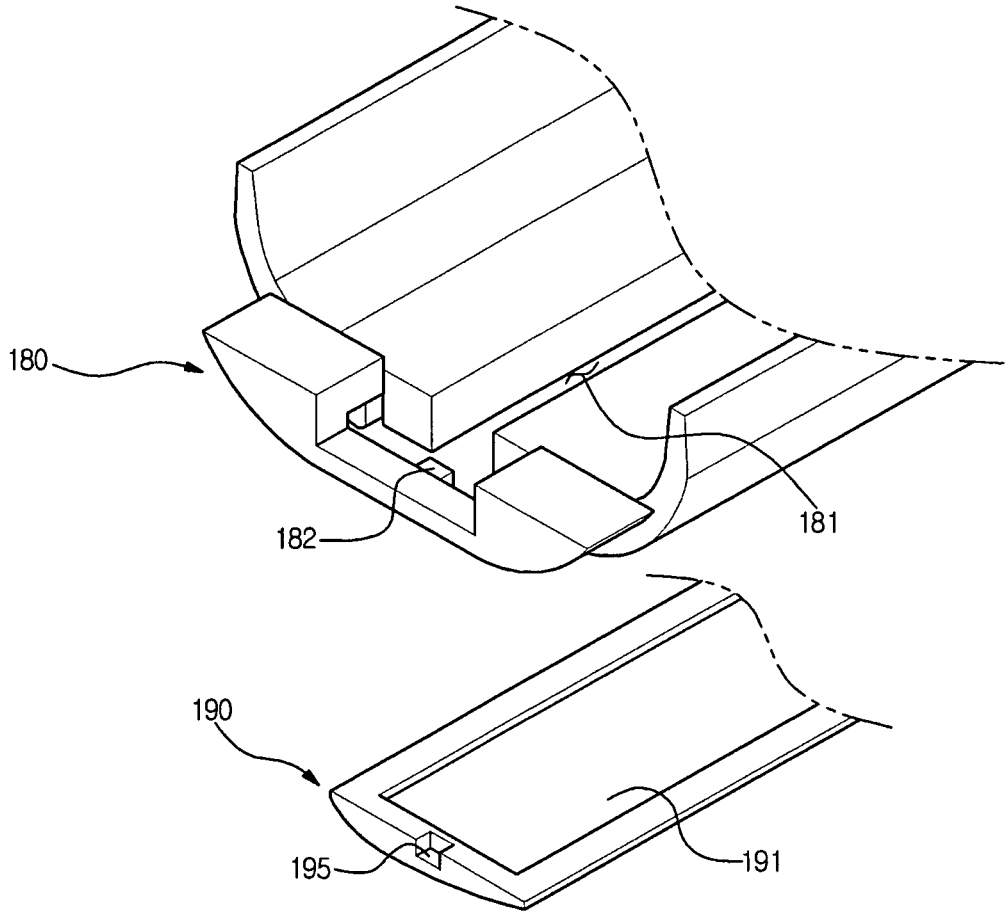
FIG. 5 is a perspective view illustrating a recess and a protrusion for installation of a nip forming member for use in the image forming apparatus according to the embodiment.

Therefore, to enable accurate installation of the nip forming member 190, as illustrated in FIG. 5, one lateral end of the nip forming member 190 is provided with a recess 195, and the belt guide member 180 is provided at a position corresponding to the recess 195 with a protrusion 182.

With the above described configuration, if the nip forming member 190 accesses the belt guide member 180 in a correct installation direction, the protrusion 182 is inserted into the recess 195, allowing the nip forming member 190 to be installed to the belt guide member 180. On the other hand, if the nip forming member 190 accesses the belt guide member 180 in an incorrect installation direction, the protrusion 182 is supported on the other lateral of the nip forming member 190, causing the nip forming member 190 to protrude from the belt guide member 180 and informing of the installation direction of the nip forming member 190 being incorrectly set.

Referring again to FIG. 3, the pressure roller 104 is arranged to face the fusing belt 120 and defines the fusing nip N when being pressed toward the fusing belt 120 by a pressure device (not shown) such as a spring. The pressure roller 104 is rotated upon receiving power from a drive source (not shown) mounted in the main body 5 of the image forming apparatus 1.

The pressure roller 104 includes a shaft 141 and an elastic layer 142. The shaft 141 is located in the center of the pressure roller 104 and serves as a rotating shaft to support components thereon. The shaft 141 may be made of a metal such as aluminum or steel. The elastic layer 142 is arranged to surround the shaft 141 and is elastically deformed as the pressure roller 104 is pressed toward the fusing belt 120, thereby defining the fusing nip N along with the fusing belt 120. The elastic layer 142 may be typically made of silicon rubber. A release layer 143 is provided on a surface of the elastic layer 142 to prevent the recording medium S from adhering to the pressure roller 104.

Figure 6:
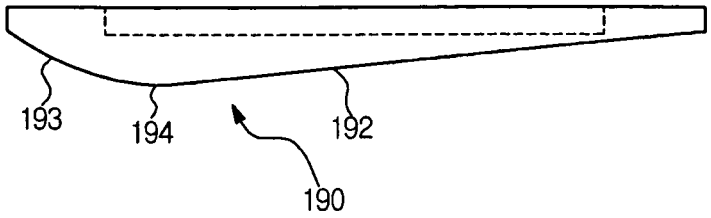
FIGS. 6 to 8 are sectional views of a nip forming member for use in an image forming apparatus according to other embodiments.
Figure 7:
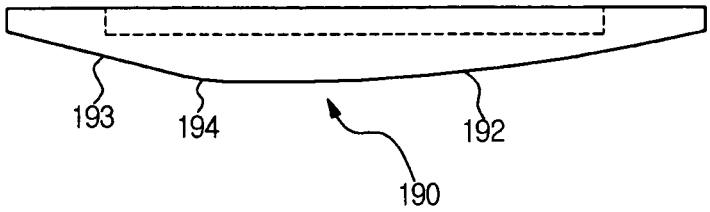

Although both the first surface 192 and the second surface 193 are curved in the present embodiment, they are not limited thereto, and only one of the first surface 192 and the second surface 193 may be a curved surface. FIG. 6 illustrates an embodiment in which the first surface 192 is an inclined surface and the second surface 193 and the hill portion 194 are curved surfaces. Also, FIG. 7 illustrates an embodiment in which the second surface 193 is an inclined surface and the first surface 192 and the hill portion 194 are curved surfaces. These embodiments may obtain similar operational effects as the case in which both the first surface 192 and the second surface 193 are curved surfaces.

Figure 8:
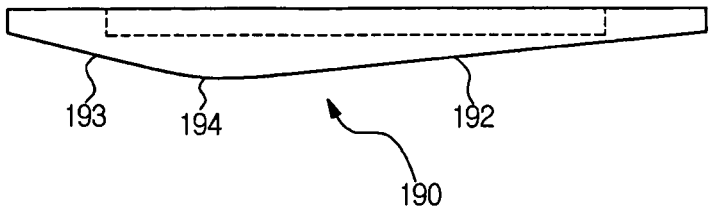

Alternatively, as illustrated in FIG. 8, both the first surface 192 and the second surface 193 may be inclined surfaces and the hill portion 194 alone may be formed of a curved surface. In this case, the second surface 193 may have a greater inclination angle than the first surface 192 to reduce curling of the recording medium S.

As is apparent from the above description, according to the embodiment, a nip forming member includes a hill portion located to one side of the nip forming member farther downstream in a movement direction of a recording medium. The hill portion acts to press the recording medium passing therethrough, causing the recording medium which has curled in a given direction to be bent in an opposite direction. Thereby, the nip forming member provided with the hill portion may function to reduce curling of the recording medium.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A fusing device comprising:

a fusing belt;

a pressure roller disposed to face the fusing belt and serving to press a recording medium onto the fusing belt;

a nip forming member to support an inner surface of the fusing belt so as to form a fusing nip along with the pressure roller; and a heat source disposed inside the fusing belt to simultaneously apply radiant heat to the fusing belt and the nip forming member, wherein the nip forming member includes a first surface provided upstream in a movement direction of the recording medium and configured to ascend toward the pressure roller in the movement direction of the recording medium, a second surface provided downstream in the movement direction of the recording medium and configured to descend away from the pressure roller in the movement direction of the recording medium, and a hill portion formed at a boundary between the first surface and the second surface, and wherein the hill portion is located to one side of the nip forming member farther downstream in the movement direction of the recording medium and directly pressed by the pressure roller.

2. The fusing device according to claim 1, wherein the hill portion is formed of a curved surface.

3. The fusing device according to claim 1, wherein at least one of the first surface and the second surface is a curved surface.

4. The fusing device according to claim 3, wherein the first surface and the second surface are respectively curved surfaces, and the second surface has a smaller radius of curvature than the first surface.

5. The fusing device according to claim 3, wherein the first surface is an inclined surface and the second surface is a curved surface.

6. The fusing device according to claim 1, wherein the first surface and the second surface are respectively inclined surfaces.

7. The fusing device according to claim 6, wherein the second surface has a greater inclination angle than the first surface.

8. The fusing device according to claim 1, wherein the hill portion is located at a position three quarters of the nip forming member farther downstream in the movement direction of the recording medium.

9. The fusing device according to claim 1, wherein the nip forming member is made of aluminum, and includes an oxide film formed on the first surface, the second surface and a surface of the hill portion through anodization, and a ceramic-teflon coating layer is formed on the oxide film.

10. The fusing device according to claim 1, wherein the heat source includes a lamp to generate radiant heat.

11. The fusing device according to claim 1, further comprising:

a supporting member to rotatably support the fusing belt, inside of which the heat source is disposed;

a belt guide member to support the fusing belt near the fusing nip, to which the nip forming member is installed; and a heat transfer member disposed to face the heat source to transfer the heat generated from the heat source to the nip forming member.

12. The fusing device according to claim 11, wherein the heat transfer member includes a body disposed to face the heat source, a pair of extensions spaced apart from each other to extend toward the nip forming member, and heat transfer portions provided at ends of the pair of extensions to transfer heat to the nip forming member.

13. The fusing device according to claim 12, wherein the nip forming member includes a recessed receiving portion in which the heat transfer portions are received.

14. The fusing device according to claim 12, wherein:

the supporting member includes a first opening to allow the radiant heat generated from the heat source to reach the nip forming member, and a second opening to allow the radiant heat generated from the heat source to reach the fusing belt;

the heat transfer member includes a third opening corresponding to the second opening provided at an opposite side of the heat transfer portions; and the belt guide member includes a fourth opening corresponding to the first opening and the pair of extensions.

15. The fusing device according to claim 11, wherein one of the nip forming member and the belt guide member is provided with a protrusion, and the other one of the nip forming member and the belt guide member is provided with a recess to correspond to the protrusion.

16. A fusing device comprising:

a fusing belt;

a pressure roller disposed to face the fusing belt and serving to press a recording medium onto the fusing belt;

a nip forming member to support an inner surface of the fusing belt so as to form a fusing nip along with the pressure roller; and a heat source disposed inside the fusing belt to simultaneously apply radiant heat to the fusing belt and the nip forming member, wherein the nip forming member includes a first surface provided upstream in a movement direction of the recording medium, the first surface being a curved surface, a second surface provided downstream in the movement direction of the recording medium, the second surface being a curved surface having a smaller radius of curvature than that the first surface, and a hill portion formed at a boundary between the first surface and the second surface and formed of a curved surface, and wherein the hill portion is located to one side of the nip forming member farther downstream in the movement direction of the recording medium and is directly pressed by the pressure roller.

17. A fusing device comprising:

a fusing belt;

a pressure roller disposed to face the fusing belt and serving to press a recording medium onto the fusing belt;

a nip forming member to support an inner surface of the fusing belt so as to form a fusing nip along with the pressure roller; and a heat source disposed inside the fusing belt to simultaneously apply radiant heat to the fusing belt and the nip forming member, wherein the nip forming member includes a hill portion protruding toward the pressure roller and located to one side of the nip forming member farther downstream in a movement direction of the recording medium, the hill portion being directly pressed by the pressure roller.

18. An image forming apparatus comprising a fusing device to apply heat and pressure to a recording medium passing through a fusing nip, wherein the fusing device includes a fusing belt, a pressure roller disposed to face the fusing belt, a nip forming member to support an inner surface of the fusing belt so as to form the fusing nip along with the pressure roller, and a heat source disposed inside the fusing belt to simultaneously apply radiant heat to the fusing belt and the nip forming member, wherein the nip forming member includes a first surface provided upstream in a movement direction of the recording medium and configured to ascend toward the pressure roller in the movement direction of the recording medium, a second surface provided downstream in the movement direction of the recording medium and configured to descend away from the pressure roller in the movement direction of the recording medium, and a hill portion formed at a boundary between the first surface and the second surface, and wherein the hill portion is located to one side of the nip forming member farther downstream in the movement direction of the recording medium and directly pressed by the pressure roller.

19. The image forming apparatus according to claim 18, wherein the hill portion is a curved surface.

20. The image forming apparatus according to claim 18, wherein at least one of the first surface and the second surface is a curved surface.

21. The image forming apparatus according to claim 20, wherein:

the first surface and the second surface are respectively curved surfaces; and the second surface has a smaller radius of curvature than the first surface.

22. The image forming apparatus according to claim 20, wherein the first surface is an inclined surface and the second surface is a curved surface.

23. The image forming apparatus according to claim 18, wherein the first surface and the second surface are respectively inclined surfaces.

24. The image forming apparatus according to claim 23, wherein the second surface has a greater inclination angle than the first surface.

* * * * *